US005832808A

United States Patent [19]

Ishizaki et al.

[11] Patent Number: 5,832,808

[45] Date of Patent: Nov. 10, 1998

[54] DIRECTIONAL CONTROL VALVE UNIT

[75] Inventors: Naoki Ishizaki; Toshiro Takano, both of Tochigi-ken, Japan

[73] Assignee: Komatsu Ltd., Tokyo, Japan

[21] Appl. No.: 776,675

[22] PCT Filed: Aug. 3, 1995

[86] PCT No.: PCT/JP95/01547

§ 371 Date: Feb. 4, 1997

§ 102(e) Date: Feb. 4, 1997

[87] PCT Pub. No.: WO96/04481

PCT Pub. Date: Feb. 15, 1996

[30] Foreign Application Priority Data

Aug. 5, 1994 [JP] Japan ..... 6-184534
Dec. 8, 1994 [JP] Japan ..... 6-304967

[51] Int. Cl.[6] ..... F15B 11/08

[52] U.S. Cl. ..... 91/447; 91/421; 91/436; 91/461; 137/625.63; 137/625.66

[58] Field of Search ..... 91/446, 447, 421, 91/436, 6, 464, 461; 137/625.63, 625.66

[56] References Cited

U.S. PATENT DOCUMENTS 4,450,865 5/1984 Tardy ..... 137/625.63 X
4,623,003 11/1986 Leonard ..... 137/625.63 X
4,782,859 11/1988 Constantinian ..... 91/464 X
5,022,434 6/1991 Tsukimoto ..... 91/436 X
5,036,750 8/1991 Katayama ..... 91/464
5,386,697 2/1995 Claudinon et al. ..... 91/446 X

FOREIGN PATENT DOCUMENTS 2-85503 3/1990 Japan .
3-28501 2/1991 Japan .

*Primary Examiner*—Hoang Nguyen
*Attorney, Agent, or Firm*—Wenderoth, Lind & Ponack, L.L.P.

[57] ABSTRACT

A directional control valve unit includes a first actuator port connected to a raising side chamber of a working machine cylinder. In addition, a second actuator port is connected to a lowering side chamber of the working machine cylinder. A regeneration passage makes the second actuator port communicate with a regeneration port through a check valve. A main spool is adapted to supply a pressure oil to the second actuator port and to make the first actuator port communicate with a tank port and the regeneration port by moving the main spool in one direction. The directional control valve unit also includes a switching device for switching the maximum moving distance of the main spool in the one direction in a plurality of stages.

6 Claims, 6 Drawing Sheets

DIRECTIONAL CONTROL VALVE UNIT

TECHNICAL FIELD

The present invention relates to a directional control valve unit for supplying a pressure oil to a cylinder of a working machine. Specifically the cylinder is for moving the working machine up and down. The working machine may be an arm or a boom of a hydraulic shovel.

BACKGROUND ART

A working machine is moved up and down by extending or retracting a working machine cylinder through the supply of a drain pressure oil from a hydraulic pump to a raising (to move the machine up) side chamber and a lowering (to move the machine down) side chamber of the working machine cylinder. A directional control valve unit is used to supply the drain pressure oil. In order to increase a lowering speed of the working machine (i.e., the retracting operation speed of the working machine cylinder) a portion of a return flow rate from the raising side chamber is supplied (i.e., reproduced) to the lowering side chamber, thus rapidly contracting the working machine cylinder.

For example, as disclosed in Japanese Patent Laid-open Publication No. HEI 3-28501, there is known a directional control valve unit in which a first port is connected to a lowering side chamber of a working machine cylinder and is in communication with a regeneration port via a regeneration passage provided with a check valve. A second port is connected to a raising side chamber of the working, machine cylinder and is in communication with a tank port. The second port is also in communication with the regeneration port. Thus, regeneration of a portion of a return flow rate from the raising side chamber to the first port through the regeneration passage occurs. Hence, the lowering speed of the working machine is increased.

According to the directional control valve unit of the structure described above, the lowering speed of the working machine cylinder can be increased by an amount corresponding to the regeneration flow rate of a pressure oil flowing from the raising side chamber to the lowering side chamber without increasing the flow rate from the hydraulic pump.

In such a directional control valve unit, an opening area between the second port and the tank port (i.e., the meter-out opening area) and an opening area between the second port and the regeneration port (i.e., the regeneration opening area) are increased or decreased in accordance with the moving distance (displacement) of the spool. Accordingly, the regeneration flow rate is determined by the moving distance of the spool. Hence, the lowering speed of the working machine cylinder is univocally determined by the moving distance of the spool.

Furthermore, since the spool of the directional control valve unit is moved by a pilot pressure from a hydraulic pilot valve, the moving distance of the spool may be changed by adjusting the pilot pressure. However, it is difficult to always univocally change the moving distance, and moreover, it is impossible to change the moving distance to a different predetermined value. Therefore, it is impossible to change the lowering speed of the working machine cylinder to a different speed.

Further, in cases where a deep excavation is performed by a hydraulic shovel, since a bucket is moved a long distance vertically, it is necessary to increase the lowering speed of the working machine cylinder to a level greater than that in a usual excavation in order to improve the excavating efficiency.

In view of the above problems, an object of the present invention is, therefore, to provide a directional control valve unit capable of changing a lowering speed of a working machine cylinder in a plurality of stages. The lowering speed is changed by increasing or decreasing a meter-out opening area and a regeneration opening area through the changing of the maximum moving distance of a main spool in a plurality of stages in one direction. The lowering speed is also changed by increasing and decreasing the flow rate of a return oil from a raising side chamber of the working machine cylinder to a lowering side chamber and the flow rate to a tank.

SUMMARY OF THE INVENTION

In order to achieve the above object, according to one embodiment of the present invention, there is provided a directional control valve unit which comprises a first actuator part, a second actuator port, a regeneration passage, and a main spool. The first actuator port is connected to a raising side chamber of a working machine cylinder. The second actuator port is connected to a lowering side chamber of the working machine cylinder. The regeneration passage makes the second actuator port communicate with a regeneration port through a check valve. The main spool is adapted to supply a pressure oil to the second actuator port and to make the first actuator port communicate with a tank port and the regeneration port by moving the main spool in one direction. The directional control valve unit is characterized in that a switching means is disposed for switching the maximum moving distance of the main spool in the one direction in a plurality of stages.

According to this structure, the meter-out opening area and the regeneration opening area can be increased and decreased by switching the maximum moving distance of the main spool in the one direction in a plurality of stages. Therefore, the regeneration flow rate for supplying a return oil from the raising side chamber of the working machine cylinder to the lowering side chamber thereof is increased and decreased to thereby change the lowering speed of the working machine cylinder in a plurality of stages.

In the above structure, it is desired that the switching means is provided with a main pressure receiving chamber, a second pressure receiving chamber, a piston, a stopper, and a change-over valve. The main pressure receiving chamber is for pressing the main spool in the one direction by a pilot pressure introduced into the pressure receiving chamber. The second pressure receiving chamber receives the introduction of the pilot pressure. The piston is for pressing the main spool in the one direction by a pressure in the second pressure receiving chamber. The stopper is for limiting the maximum moving distance of the main spool to a value different from the maximum moving distance of the piston. The change-over valve is for selectively switching the introduction of the pilot pressure into the main pressure receiving chamber or the second pressure receiving chamber.

In addition, it is desired to make the maximum moving distance of the piston smaller than that of the main spool and to make the pressure receiving area of the piston smaller than that of the main spool in the main pressure receiving chamber.

Furthermore, the switching means may be provided with a stopper, a second pressure chamber, a piston, and a change-over valve. The stopper is for limiting the maximum moving distance in the one direction of the main spool. The second pressure chamber receives the introduction of a pressure oil from another pressure source. The piston which is formed as a stopper receiver for the stopper, is slidable in the moving direction of the main spool and is slid to the stopper side by a predetermined distance by the pressure in the second pressure receiving chamber. The change-over valve is for switching supply and discharge of the pressure oil to the second pressure receiving chamber.

Still furthermore, an auxiliary spring may be disposed between the stopper and the piston.

BRIEF DESCRIPTION OF THE DRAWINGS

The present invention will be made more understandable by the following detailed disclosure and the accompanying drawings representing embodiments of the present invention. Further, it is to be noted that the embodiments shown by the accompanying drawings are not intended to limit the present invention and are for easy understanding of the disclosure.

In the accompanying drawings.

PREFERRED MODES FOR EMBODYING THE INVENTION

Directional control valve units according to the preferred embodiments will be described hereunder with reference to the accompanying drawings.

Figure 1:
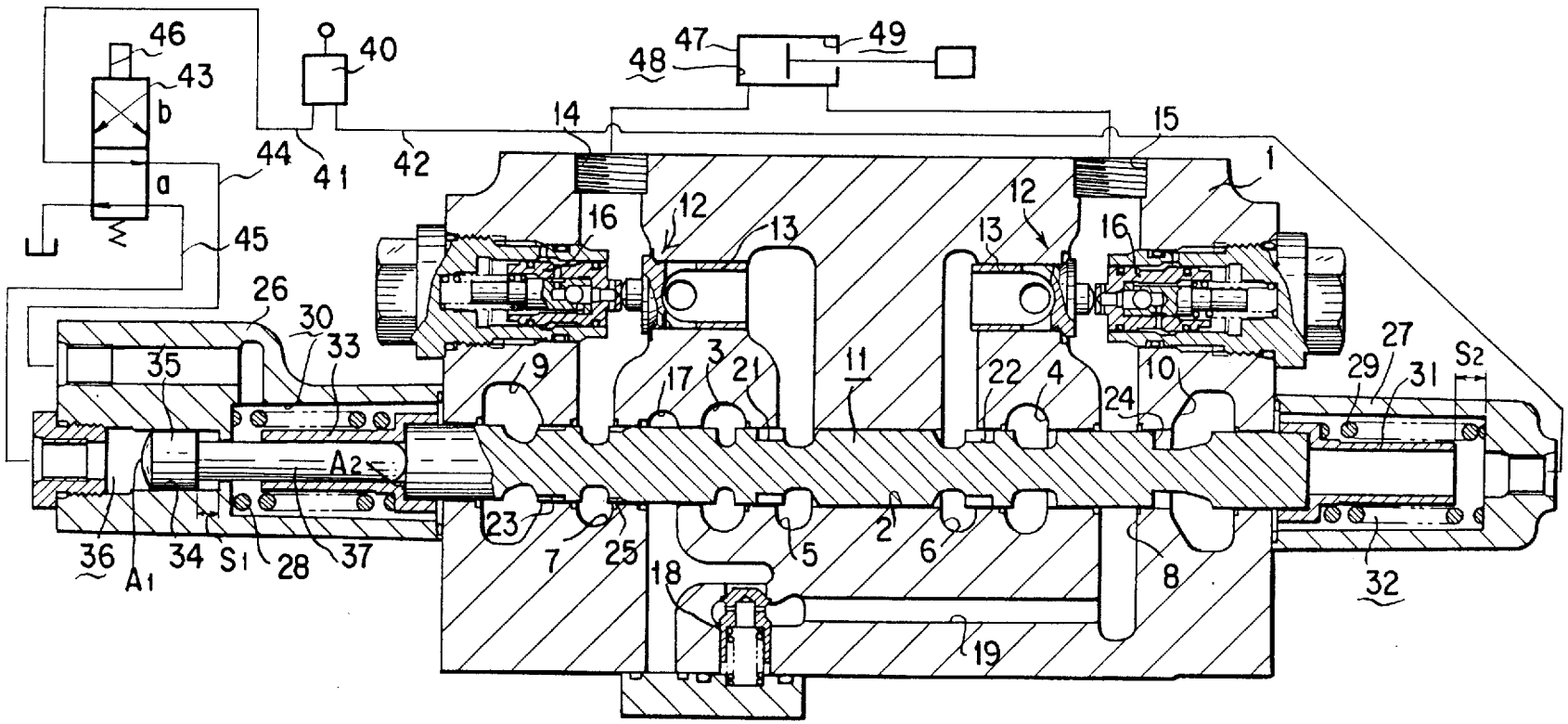
FIG. 1 is a sectional view of a first embodiment of a directional control valve unit according to the present invention.

FIG. 1 represents a first embodiment. With reference to FIG. 1, a valve body 1 is formed with a spool bore 2 which is in fluid communication with first and second pump ports 3 and 4, first and second meter-in ports 5 and 6, first and second meter-out ports 7 and 8, and first and second tank ports 9 and 10. The respective ports are placed in communication with each other or blocked from communication with each other by slidingly inserting a main spool 11 into the spool bore 2.

The first and second meter-in ports 5 and 6 are connected to the first and second actuator ports 14 and 15 through a valve 13 of a pressure compensation valve device 12. The first and second actuator ports 14 and 15 are in fluid communication with the first and second meter-out ports 7 and 8. The valve 13 of the pressure compensation valve device 12 is pushed toward a valve closing direction by a compensation piston 16.

The pressure compensation valve device 12 may be substituted with a check valve.

The spool bore 2 also has a regeneration port 17 formed between the first pump port 3 and the first meter-out port 7. The regeneration port 17 is in fluid communication with the second meter-out port 8 through a regeneration passage 19 equipped with a check valve 18.

The main spool 11 is formed with a first cutout groove 21 for controlling an oil flow rate from the first pump port 3 to the first meter-in port 5, a second cutout groove 22 for controlling an oil flow rate from the second pump port 4 to the second meter-in port 6, a third cutout groove 23 for controlling an oil flow rate from the first meter-out port 7 to the first tank port 9, a fourth cutout groove 24 for controlling an oil flow rate from the second meter-out port 8 to the second tank port 10, and a fifth cutout groove 25 for controlling an oil flow rate from the first meter-out port 7 to the regeneration port 17.

The valve body 1 has bilateral wall sections to which first and second spring boxes 26 and 27 are attached, respectively. The main spool 11 is maintained in a neutral position by a first spring 28 disposed in the first spring box 26 and a second spring 29 disposed in the second spring box 27. The main spool 11 is pushed rightward by the pressure oil in a first main pressure receiving chamber 30 formed in the first spring box 26. The rightward moving distance of the main spool 11 is limited by a first stopper 31 disposed in the second spring box 27. The main spool 11 is pushed leftward by the pressure in a second main pressure receiving chamber 32. The leftward moving distance is limited by a second stopper 33 disposed in the first spring box 26. The rightward and leftward maximum moving distances (strokes) $S_2$ of the main spool 11 are equal to each other.

The first spring box 26 is formed with a stepped bore 34 into which a piston 35 is fitted to form a pressure receiving chamber 36. The piston 35 has a small diameter portion 37 contacting a left end surface of the main spool 11. Thus, the pressure in the pressure receiving chamber 36 pushes the main spool 11 rightwardly through the piston 35 when pressure oil is supplied in the pressure receiving chamber 36. The maximum moving distances (stroke) $S_1$ of the piston is smaller than the stroke $S_2$ of the first stopper 31. In addition, the pressure receiving area $A_1$ of the piston is smaller than the pressure receiving area $A_2$ of the main spool 11.

A hydraulic pilot valve 40 supplies a pilot pressure oil to one of the first and second pilot passages 41 and 42. The first pilot passage 41 is equipped with a change-over valve 43, which is connected to one of the first and second circuits 44 and 45. The first circuit 44 is connected to the first main pressure receiving chamber 30 and the second circuit 45 is connected to the pressure receiving chamber 36. The second pilot passage 42 is connected to the second main pressure receiving chamber 32.

The change-over valve 43 is held at a first position a at which the first pilot passage 41 is in fluid communication with the first circuit 44 by a spring force and the second circuit 45 is in fluid communication with a tank. When a solenoid 46 is electrically energized, the changeover valve 43 is switched to a second position b at which the first pilot passage 41 is changed to connect with the second circuit 45 and the first circuit is placed in fluid communication with the tank.

The first actuator port 14 is connected to the raising side chamber 48 of the working machine cylinder 47. The second actuator port 15 is connected to the lowering side chamber 49.

The first embodiment of the structure described above will operate in the following manner.

When the change-over valve 43 takes the first position a, the hydraulic pilot valve 40 is operated to supply the pilot pressure oil to the first pilot passage 41. The pilot pressure oil is then supplied to the first main pressure receiving chamber 30. Next, the pressure in the first main pressure receiving chamber 30 presses the left end surface of the main spool 11, thereby sliding it in the rightward direction. At this time, the maximum moving distance (displacement) of the main spool 11 corresponds to the moving distance $S_2$ as determined by the size of the first stopper 31.

Then, the pressure oil of the second pump port 4 flows into the second meter-out port 6 through the second cutout groove 22. The pressure oil is then supplied to the lowering side chamber 49 of the working machine cylinder 47 via the valve 12 and the second actuator port 15.

At the same time, the first meter-out port 7 is placed in fluid communication with the first tank port 9 via the third cutout groove 23. The opening area between the first meter-out port and the first tank port (meter-out opening area) provides a value corresponding to the moving distance $S_2$ of the main spool 11. The first meter-out port 7 is placed in fluid communication with the regeneration port 17 via the fifth cutout groove 25. The opening area between the first meter-out port and the regeneration port (regeneration opening area) provides a value corresponding to the moving distance $S_2$ of the main spool ii.

Accordingly, a portion of the return flow of the pressure oil from the raising side chamber 48 of the working machine cylinder 47 is returned and regenerated to the lowering side chamber 49 of the working machine cylinder 47 via the regeneration port 17, the regeneration passage 19, the second meter-out port 8 and the second actuator port 15. Thus the lowering speed of the working machine cylinder 47 is increased.

On the other hand, when the change-over valve 43 takes the second position b, the pilot pressure oil is supplied to the first pilot passage 41 through the operation of the hydraulic pilot valve 40. The pilot pressure oil is then supplied to the pressure receiving chamber 36 and the main spool 11 is hence slid rightwardly by the pressure of the supplied pressure oil. Therefore, in the manner similar to that mentioned above, a portion of the return flow of the pressure oil from the raising side chamber of the working machine cylinder 47 is regenerated in the lowering side chamber 49 thereof.

At this time, since the main spool 11 moves by the distance $S_1$, which is smaller than the distance $S_2$, the meter-out opening area and the regeneration opening area are smaller. Thus, the flow rate of the pressure oil to the tank and the regeneration flow rate are reduced. Thus, the lowering speed of the working machine cylinder 47 is slower in comparison with the case described above.

Incidentally, when the pilot pressure oil is supplied to the first main pressure receiving chamber 30, the pressure of the pilot pressure oil directly pushes the end surface of the main spool 11. In contrast, when the pilot pressure oil is supplied to the pressure receiving chamber 36, the pressure of the pilot pressure oil pushes the main spool 11 through the displacement of the piston 35. Since the pressure receiving area $A_2$ of the end surface of the main spool 11 is larger than the pressure receiving area $A_1$ of the piston 35, the pressure force pushing the main spool 11 in the rightward direction is greater where the pilot pressure oil is supplied to the first main pressure receiving chamber 30 in comparison with the case where the pilot pressure oil is supplied to the pressure receiving chamber 36. Hence, the moving distance of the main spool 11 is larger when the pressure oil is supplied to the first main pressure receiving chamber even though the same pilot pressure is applied.

Figure 2:
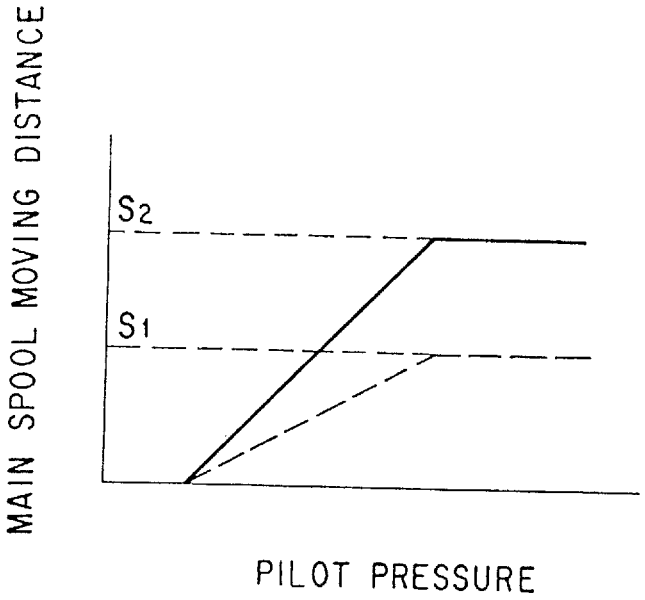
FIG. 2 is a graph representing a relationship between a moving distance of a main spool of the first embodiment and a pilot pressure.

Therefore, when the pressure oil is supplied to the first main pressure receiving chamber 30, as shown with the solid line in FIG. 2, the changing rate of the moving distance (inclination of the solid line) of the main spool 11 with respect to the change of the pilot pressure becomes large and the maximum moving distance thereof becomes a long distance $S_2$. On the other hand, when the pressure oil is supplied to the pressure receiving chamber 36, the changing rate of the moving distance (inclination of the broken line in FIG. 2) of the main spool 11 with respect to the change of the pilot pressure becomes small and the maximum moving distance thereof becomes a short distance $S_1$.

Figure 3:
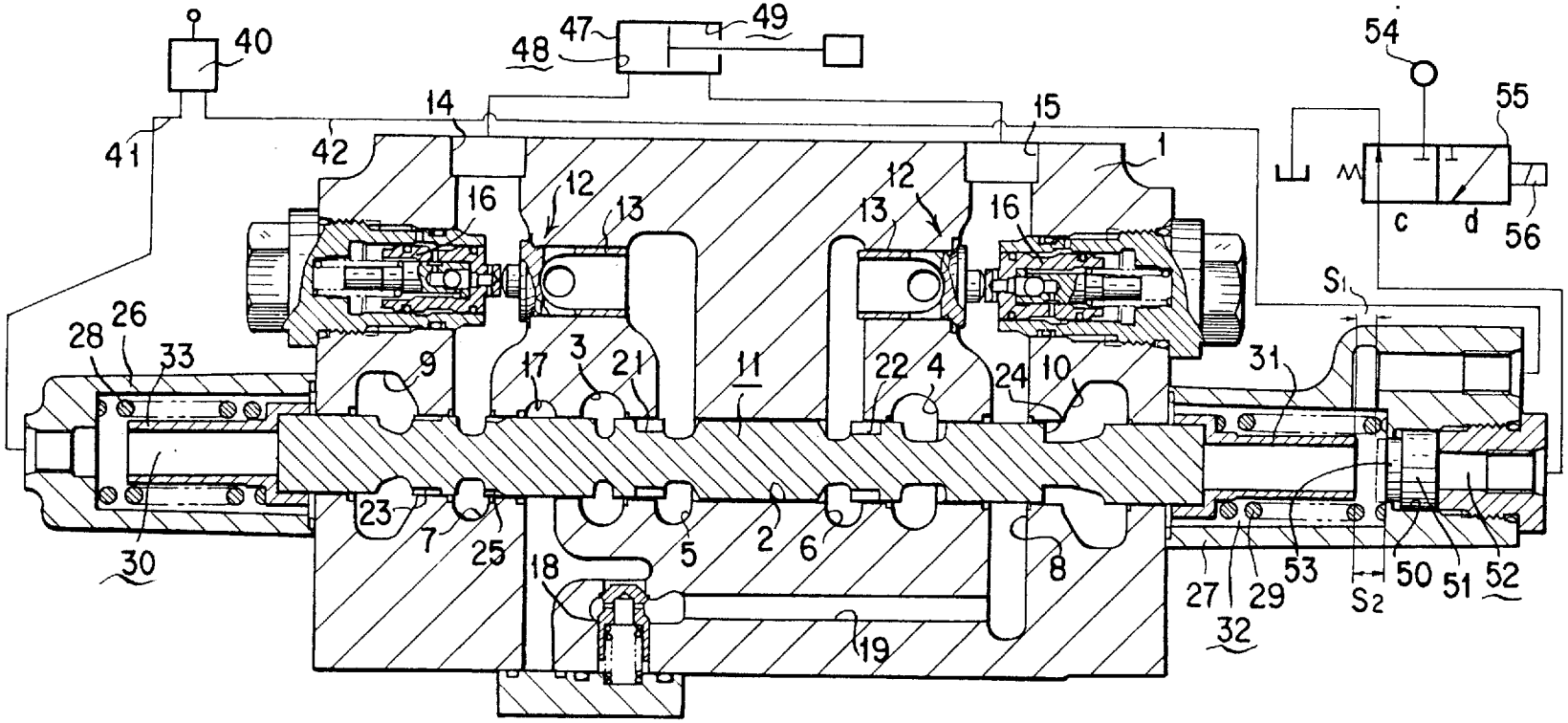
FIG. 3 is a sectional view of a second embodiment of a directional control valve unit according to the present invention.

FIG. 3 represents a second embodiment of the present invention. With reference to. FIG. 3, the first spring box 26 is provided with only the first main pressure receiving chamber 30. On the other hand, the second spring box 27 is formed with a stepped bore 50, in which a stepped piston 51 is fitted. A pressure receiving chamber 52 is thereby formed such that the piston 51 has a small diameter portion 53 opposing the first stopper 31 to form a stopper receiver. When the piston 51 takes a rightward position the first stopper 31 has a stroke $S_2$ and when the piston 51 takes a leftward position, the first stopper has a stroke $S_1$.

The pressure oil in a hydraulic oil source 54 is supplied to the pressure receiving chamber 52 by way of a change-over valve 55.

The change-over valve 55 is maintained, by a spring force, to a drain position c at which the pressure receiving chamber 52 is placed in fluid communication with the tank. When a solenoid 56 is electrically energized, the change-over valve 55 is switched to a supply position d at which the pressure oil in the hydraulic source 54 is supplied to the pressure receiving chamber 52.

The second embodiment will operate in the following manner.

When the change-over valve 55 takes the drain position by the spring force, the pressure receiving chamber 52 is in fluid communication with the tank and the piston 51 is pushed in the rightward direction by the first stopper 31 to the stroke end position. Thus, the main spool 11 moves rightward by the moving distance $S_2$. Then, when the solenoid 56 is electrically energized to switch the position of the change-over valve 55 to the supply position d, the pressure oil is supplied to the pressure receiving chamber 52 and the piston 51 is pushed leftward. Consequently, the small diameter portion 53 of the piston 51 extends into the second main pressure receiving chamber 32 to limit the rightward movement of the first stopper 31 to the distance $S_1$. Accordingly, the rightward moving distance of the main spool 11 is limited to the distance $S_1$.

Figure 4:
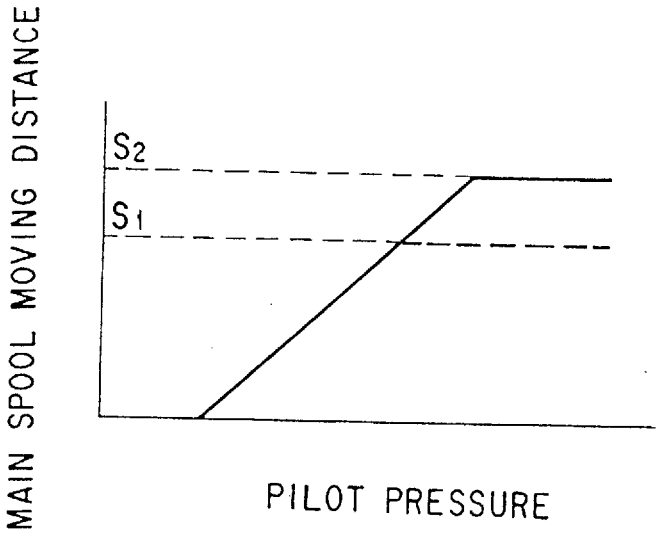
FIG. 4 is a graph representing a relationship between a moving distance of a main spool of the second embodiment and a pilot pressure.

According to the manner described above, the maximum moving distance in the rightward direction of the main spool 11 can be changed to different values as shown with the solid and broken lines, respectively, in FIG. 4. Further, in these cases, the changing rates of the moving distances (inclinations of the solid and broken lines in FIG. 4) of the main spool 11 with respect to the change of the pilot pressure becomes the same value.

Figure 5:
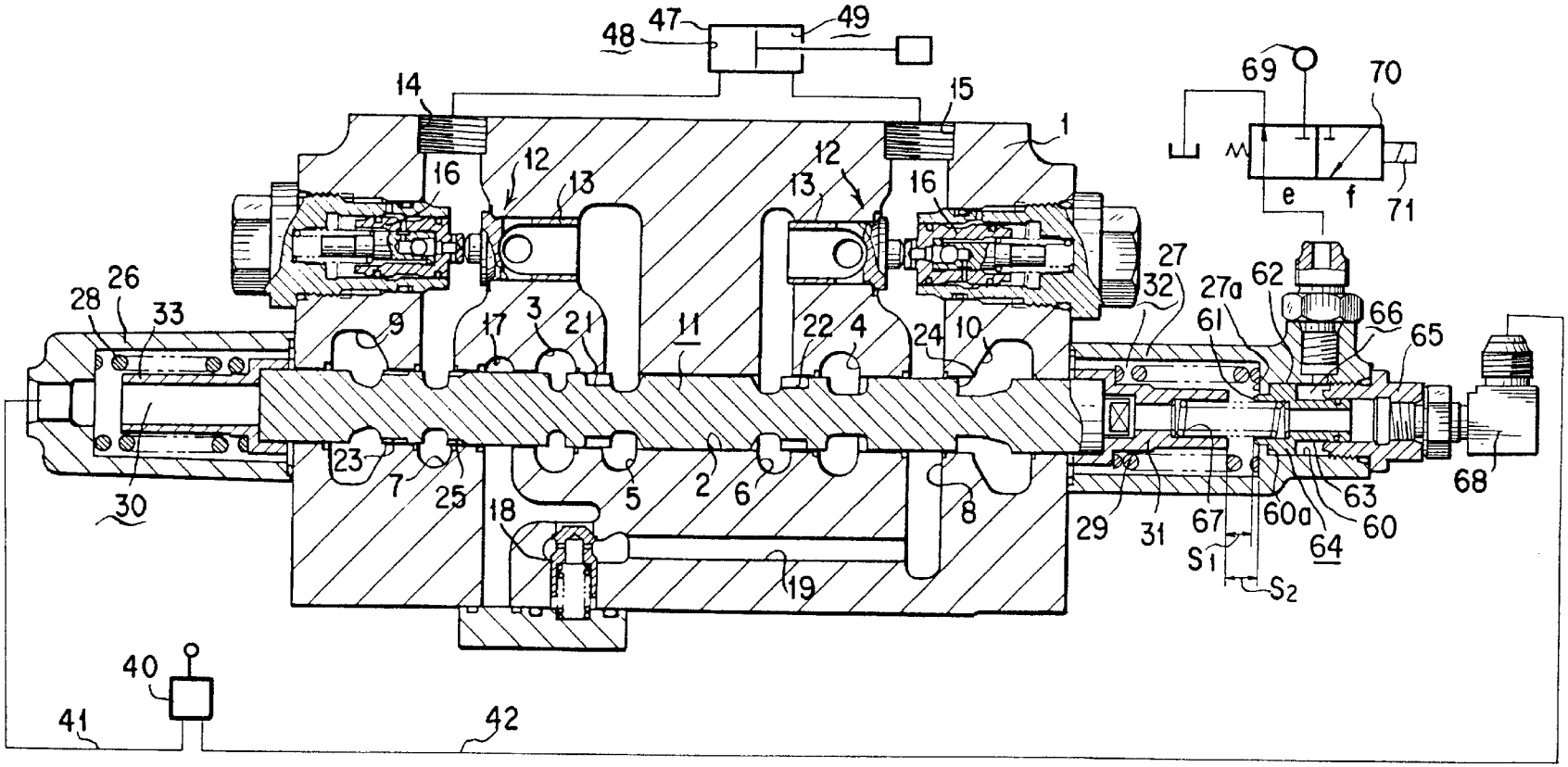
FIG. 5 is a sectional view of a third embodiment of a directional control valve unit according to the present invention.

FIG. 5 represents a third embodiment of the present invention. With reference to FIG. 5, the first spring box 26 is provided with only the first main pressure receiving chamber 30. On the other hand, the second spring box 27 is formed with a stepped bore 60 which is opened to the second pressure receiving chamber 32. In addition, the stepped bore 60 is fitted with a stepped cylindrical piston 64 having one end small diameter portion 61, an intermediate large diameter portion 62 and another end small diameter portion 63. The one end small diameter portion 61 of the piston 64 is opposed to the first stopper 31 to form a stopper receiver. The another end small diameter portion 63 of the piston 64 is fitted in a sleeve 65 which is screwed into the stepped bore 60, thus forming an annular pressure receiving chamber 66.

An auxiliary spring 67 is disposed between the piston 64 and the first stopper 31 so as to push the piston 64 rightwardly. The first stopper 31 is arranged such that when the piston 64 takes the rightward position, the first stopper 31 has the stroke $S_2$ and when it takes the leftward position, the first stopper 31 has the stroke $S_1$.

The second main pressure receiving chamber 32 is in fluid communication with the sleeve 65 via the inner portion of the piston 64. The pressure oil is supplied to the second main pressure receiving chamber 32 from an elbow member 68 screwed into the sleeve 65. The pressure oil in the hydraulic source 69 is supplied to the pressure receiving chamber 66 through operation of the change-over valve 70.

The change-over valve 70 is held in a drain position e placing the pressure receiving chamber 66 into fluid communication with the tank by a spring force. When a solenoid is electrically energized, the change-over valve 70 is switched to a supply position f at which the pressure oil is supplied from the hydraulic source 69 to the pressure receiving chamber 66.

The third embodiment will operate in the following manner.

When the change-over valve 70 is operated to take the drain position e by the spring force, the pressure receiving chamber 66 is in fluid communication with the tank. Consequently, the piston 64 is pushed rightwardly by the pushing force of the auxiliary spring 67. In this state, the spring load of the auxiliary spring 67 becomes zero. Thus, the piston 64 also serves as a spring force receiving member of the auxiliary spring 67.

In the state described above, when the pilot pressure is applied to the first main pressure receiving chamber 30 to push the main spool 11 rightwardly, the main spool 11 slides rightward against the urging force of the second spring 29. In turn, the first stopper 31 abuts against the inner end surface 27*a* of the second spring box 27. In this state, the main spool 11 stroke is distance $S_2$.

Next, when the solenoid 71 is energized to switch the change-over valve 70 to the supply position f, the pressure oil in the hydraulic source 69 is supplied to the pressure receiving chamber 66. Consequently, the piston 64 is pushed leftward so that the intermediate large diameter portion 62 abuts against the stepped portion 60*a* of the stepped bore 60*a*. At this time, the one end small diameter portion 61 of the piston 64 extends into the second main pressure receiving chamber 32 to limit the rightward moving distance of the first stopper 31 to $S_1$.

Under this state, when the pilot pressure is supplied to the first main pressure receiving chamber 30 and the main spool 11 is pushed rightward by the pilot pressure force, the main spool 11 slides rightward against the urging forces of the second spring 29 and the auxiliary spring 67. The first stopper 31 then abuts against the one end small diameter portion 61 of the piston 61. Hence, the rightward moving distance of the main spool 11 becomes $S_1$, which is smaller than the distance $S_2$ in the former operation.

Figure 6:
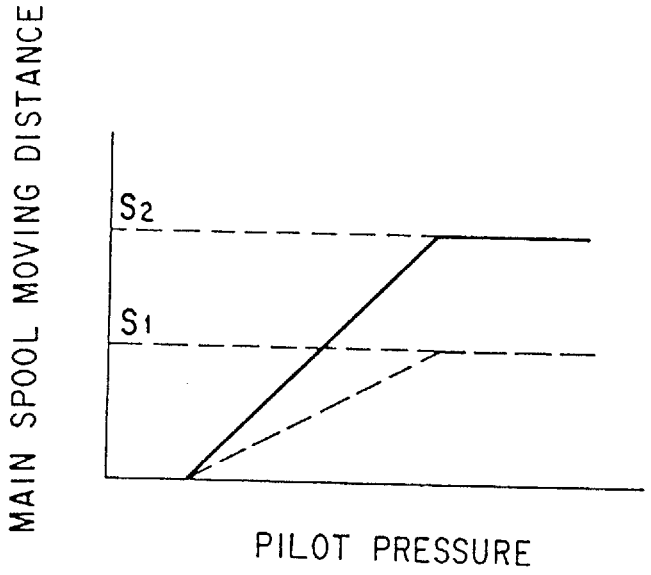
FIG. 6 is a graph representing a relationship between a moving distance of a main spool of the third embodiment and a pilot pressure.

The pilot pressure and the rightward moving distance of the main spool 11 may be represented by the relationship shown in FIG. 6.

That is, when the pressure oil is not supplied to the pressure receiving chamber 66 within the same pilot pressure range, since only the second spring 29 is operated, as shown with the solid line in FIG. 6, the changing rate (solid line inclination) of the moving distance of the main spool 11 with respect to the change of the pilot pressure becomes large and the maximum moving distance of the main spool 11 takes the relatively large distance of $S_2$. On the other hand, when the pressure oil is supplied to the pressure receiving chamber 66, since the second spring 29 and the auxiliary spring 67 are operated, as shown with the broken line in FIG. 6, the changing rate (broken line inclination) of the moving distance of the main spool 11 with respect to the change of the pilot pressure becomes large and the maximum moving distance of the main spool 11 takes a relatively small distance of $S_1$ ($S_1<S_2$).

As mentioned above, according to the directional control valve unit of the present invention, the meter-out opening area and the regeneration opening area can be increased or decreased by switching in a plurality of stages the maximum moving distance in one direction of the main spool. Consequently, the regeneration oil flow rate may be increased or decreased to supply the return oil from the raising side chamber of the working machine cylinder to the lowering side chamber thereof. The oil flow rate to the tank will also be increased or decreased. Thus, the lowering speed of the working machine cylinder may be changed in a plurality of stages.

Further, it is a self-evident matter by those skilled in the art that although the present invention was described with reference to the exemplary embodiment, other various changes, deletions and additions can be made without departing from the subject and scope of the present invention with respect to the described embodiment. Accordingly, it is to be understood that the present invention is not limited to the described embodiment and includes a scope prescribed by the elements recited in the claims and a scope equivalent thereto.

We claim:

1. A directional control valve unit which comprises a first actuator port adapted for connection to a raising side chamber of a working machine cylinder, a second actuator port adapted for connection to a lowering side chamber of the working machine cylinder, a regeneration passage which makes the second actuator port communicate with a regeneration port through a check valve and a main spool adapted to supply a pressure oil to the second actuator port and to make the first actuator port communicate with a tank port and the regeneration port by moving the main spool in one direction, and a switching means for switching a maximum moving distance of the main spool in one direction in a plurality of stages;

wherein said switching means is provided with a main pressure receiving chamber for pressing the main spool in the one direction by a pilot pressure introduced into the main pressure receiving chamber, a second pressure receiving chamber into which the pilot pressure is introduced, a piston for pressing the main spool in the one direction by a pressure in the second pressure receiving chamber, a stopper for limiting the maximum moving distance of the main spool to a value different from a maximum moving distance of the piston, and a change-over valve for selectively switching the introduction of the pilot pressure into the main pressure receiving chamber or the second pressure receiving chamber.

2. A directional control valve unit according to claim 1, wherein the maximum moving distance of the piston is made smaller than that of the main spool and a pressure receiving area of the piston is made smaller than a pressure receiving area of the main spool in the main pressure receiving chamber.

3. A directional control valve apparatus for use in controlling the flow of fluid in a cylinder, said directional control valve apparatus comprising:

a valve body having a regeneration port, a tank port, a first actuator port adapted for fluidic connection with a raising side chamber of the cylinder, and a second actuator port adapted for fluidic connection with a lowering side chamber of the cylinder;

wherein said valve body has formed therein a regeneration passage fluidically connected with said second actuator port and said regeneration port, and a main spool bore fluidically connected with said second actuator port, said first actuator port and said tank port;

wherein a check valve is operably provided in said regeneration passage;

wherein a main spool is slidingly disposed in said main spool bore and is adapted to control fluid flow to said second actuator port and to control fluid communication between said tank port and said regeneration port by moving between a plurality of positions; and wherein a switching system is fluidically connected with said main spool bore and has a main pressure receiving chamber operable to receive a pilot pressure which in turn is operable to move said main spool, a piston operably mounted to said valve body to move said main spool, a second pressure receiving chamber fluidically connected with said main pressure receiving chamber operable to also receive the pilot pressure which in turn is operable to move said piston, a stopper operably mounted to said valve body to limit a maximum moving distance of said main spool to a distance different from a maximum moving distance of said piston, and a change-over valve fluidically connected with said main pressure receiving chamber and said second pressure receiving chamber to selectively control flow of the pilot pressure into said main pressure receiving chamber or into said second pressure receiving chamber.

4. A directional control valve apparatus according to claim 3, wherein:

the maximum moving distance of said piston is less than the maximum moving distance of said main spool;

said piston has a pressure receiving area formed at an end thereof; and said main spool has a pressure receiving area formed at an end thereof which is larger than said pressure receiving area of said piston.

5. A directional control valve apparatus for use in controlling the flow of fluid in a cylinder, said directional control valve apparatus comprising:

a valve body having a regeneration port, a tank port, a first actuator port adapted for fluidic connection with a raising side chamber of the cylinder, and a second actuator port adapted for fluidic connection with a lowering side chamber of the cylinder;

wherein said valve body has formed therein a regeneration passage fluidically connected with said second actuator port and said regeneration port, and a main spool bore fluidically connected with said second actuator port, said first actuator port and said tank port;

wherein a check valve is operably provided in said regeneration passage;

wherein a main spool is slidingly disposed in said main spool bore and is adapted to control fluid flow to said second actuator port and to control fluid communication between said tank port and said regeneration port by moving between a plurality of positions; and wherein a switching system is fluidically connected with said main spool bore and has a stopper mounted to said valve body to limit a maximum moving distance of said main spool, a piston slidingly mounted adjacent said stopper to selectively abut said stopper, a pressure receiving chamber fluidically connected with said main spool bore to receive a pressure fluid which in turn is operable to move said piston, a change-over valve fluidically connected with said pressure receiving chamber to selectively control flow of the pressure fluid into and out of said pressure receiving chamber, and a spring interposed between said stopper and said piston.

6. A directional control valve apparatus according to claim 5 wherein:

said piston is operable, upon an application of a pressure fluid from said pressure receiving chamber, to limit said main spool to a first maximum moving distance and, during the absence of the application of a pressure fluid from said pressure receiving chamber, to limit said main spool to a second maximum moving distance; and said first maximum moving distance is less than said second maximum moving distance.

* * * * *